US005406758A

United States Patent [19]

Baum

[11] Patent Number: 5,406,758

[45] Date of Patent: Apr. 18, 1995

[54] COMBINED FORM AND DRIAN TITLE, AND METHOD OF USING SAME

[76] Inventor: Melvin R. Baum, R.R. 1, Morton, Ill. 61550

[21] Appl. No.: 980,191

[22] Filed: Nov. 23, 1992

[51] Int. Cl.[6] ..... E02D 19/00; E02B 11/00; E02B 13/00

[52] U.S. Cl. ..... 52/169.5; 405/43; 249/6

[58] Field of Search ..... 52/169.5, 169.14; 405/43, 45; 249/2, 3, 6, 12, 44–47

[56] References Cited

U.S. PATENT DOCUMENTS

| | | | |
|---|---|---|---|
| 3,017,722 | 1/1962 | Smith . | |
| 3,226,935 | 1/1966 | Schneller . | |
| 3,460,859 | 8/1969 | Keating . | |
| 3,613,323 | 10/1971 | Hreha . | |
| 3,654,765 | 4/1972 | Healy et al. | 61/11 |
| 3,903,704 | 9/1975 | Spiridonov . | |
| 4,045,964 | 9/1977 | Barclay | 61/11 |
| 4,490,067 | 12/1984 | Dahowski | 52/169.5 X |
| 4,574,541 | 3/1986 | Raidt et al. | 52/169.5 |
| 4,590,722 | 5/1986 | Bevelacqua | 52/169.5 |
| 4,712,764 | 12/1987 | White | 249/6 |
| 4,824,068 | 4/1989 | Ferland | 249/6 X |
| 4,832,557 | 5/1989 | Jacobsen . | |
| 4,858,958 | 8/1989 | Harbeke . | |
| 4,877,350 | 10/1989 | DiFiore | 405/38 |
| 4,930,272 | 6/1990 | Bevilacqua | 52/169.5 |
| 5,035,095 | 7/1991 | Bevilacqua | 52/169.5 |
| 5,120,162 | 6/1992 | Parker | 405/229 |

FOREIGN PATENT DOCUMENTS 61-130523 6/1986 Japan .

OTHER PUBLICATIONS

Feasibility Report for "TF–Tile Form", File No. S2650 by Melvin R. Baum.

*Primary Examiner*—Neill R. Wilson
*Attorney, Agent, or Firm*—Joseph W. Berenato, III

[57] ABSTRACT

A combined drain tile and form for a foundation perimeter drainage system includes a hollow tubular drain tile, having a longitudinal opening along one side, connected along the longitudinal opening to a planar form portion. The tubular portion has a plurality of drainage holes. The form portion acts as a wall for a concrete or cement form, thereby eliminating the step of removing the form prior to laying drain tile in a perimeter drainage system.

8 Claims, 1 Drawing Sheet

HF
HT
F
SC
CS
CF
θ

COMBINED FORM AND DRIAN TITLE, AND METHOD OF USING SAME

FIELD OF THE INVENTION

The present invention relates to perimeter drainage systems for building foundations, and to methods of constructing building foundations which include a perimeter drainage system.

BACKGROUND OF THE INVENTION

Residential and commercial building foundations are commonly comprised of several elements, including a footing which provides a wide, stable base for the perimeter of the building, a vertical wall constructed on top of the footing, and a floor constructed so that the edges of the floor rest on top of the footing and touch or nearly touch the adjacent wall. The footing and the wall, if made from concrete or cement, are constructed by pouring the cementitious material into a form, and allowing it to set and harden in the form.

A problem with this type of construction, however, is that there is an opportunity for water to leak or seep through the foundation. Therefore, perimeter drainage systems have been developed to help prevent water pooling near the foundation, and subsequently to alleviate the problem of water leakage or seepage through the foundation.

Typically, such drainage systems incorporate several elements, including drain tubing or drain tile followed by backfilling with gravel and then soil. The drain tile is generally made from flexible or rigid polyvinylchloride (PVC), or other type plastic tubing having drainage holes located circumferentially along the length of the tube. It is installed in the foundation trench generally adjacent the footing after the concrete or cement has set and the form into which it was poured is stripped away.

Installation of the drainage system in such manner around a foundation or footing requires the steps of digging a trench, building a form, pouring the cementitious material into the form, and allowing it to set or harden. Then, prior to installation of the drain tile, the form, ordinarily made from wood, must be removed. This process of building the form, pouring the cementitious material, and then removing the form adds considerably to the time, and therefore to the cost, of completing the foundation.

It is, therefore, a purpose of this invention to fulfill a need in the art, which overcomes the disadvantages of the prior art devices and methods of installation, by providing an integral form and drain tile which may be manufactured by conventional means, and which produces savings in time and cost of completing the construction of a foundation having a perimeter drainage system.

SUMMARY OF THE INVENTION

This invention fulfills the above-described needs in the art by providing a combined form and drain tile comprising a planar longitudinally extending form having oppositely oriented, laterally spaced side edges, a hollow tubular drain tile secured to the form intermediate the edges and which extends substantially the length of the form, and a plurality of drain holes in the drain tile for admitting liquid into the drain tile.

The combined form and drain tile may be used to save time and cost in the process of forming a foundation which includes a perimeter drainage system. The new process includes the steps of forming a trench, providing a combined form and drain tile assembly, the assembly including a planar form portion and an associated hollow tubular tile portion, positioning the assembly with the form portion vertically disposed in the trench, thereby providing a receptacle, filling the receptacle with cementitious material, allowing the cementitious material to set, and backfilling the trench first with aggregate and then with soil.

This invention is both a drain tile and a form for receiving cementitious material, i.e. concrete or cement. By incorporating the elements of both a drain tile and a form, a foundation for a building which requires a perimeter drainage system may be constructed in less time and at a lower cost than prior art perimeter drainage systems. The combined form and drain tile of the present invention eliminates the steps of removing the form after the cementitious material has set.

Figures 1, 2, 3, 4A, 4B, 4C, 4D, 4E, 5, 6, 7:
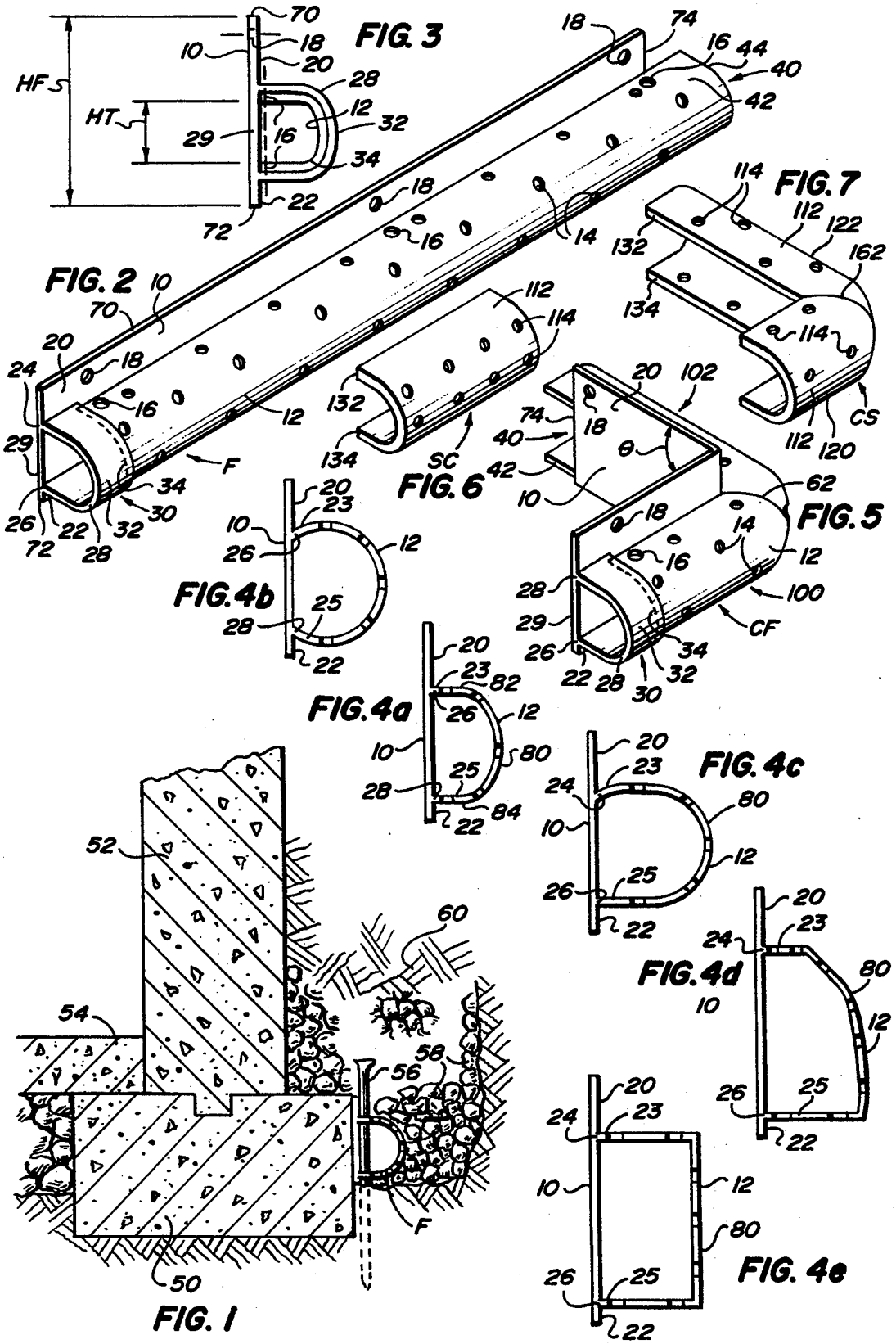
FIG. 1 is a fragmentary cross-sectional view of a typical foundation construction detail, including the combined form and drain tile of the present invention.
FIG. 2 is a perspective view of the drain tile form of the invention.
FIG. 3 is an end elevational view of the drain tile form of the invention of FIG. 2.

FIGS. *4a–4e* are cross-sectional views of various embodiments of the form of the invention.

FIG. 5 is a perspective view of a corner section of the form of the invention.

FIG. 6 is a perspective view of a slip-over connector according to the invention.

FIG. 7 is a perspective view of a slip-over corner connector according to the invention.

DETAILED DESCRIPTION OF THE INVENTION

FIG. 1 shows a typical building foundation in cross-section. The elements of the foundation include footing 50, vertical wall 52 sitting on top of footing 50, floor 54 having an end also sitting on footing 50 and an edge which touches or nearly touches vertical wall 52, and a perimeter drainage system which includes drain tile form F, aggregate backfill 58 which is placed under and around drain tile form F, and soil backfill 60 which is placed on top of aggregate 58.

Drain tile form F is more clearly shown in FIG. 2 and includes form 10 and drain tile 12. Form 10 is planar and has two opposing edges, 70 and 72, laterally spaced from each other and which extend the longitudinal length of form 10. Edges 70 and 72 may be parallel. Form 10 also has two opposing ends, 74 and 76, which extend the height of form 10.

Drain tile 12 is a hollow tube with open female and male ends, 30 and 40, respectively, but need not have a closed perimeter. The perimeter of drain tile 12 may have only three sides or may be an arc which subtends an angle of only approximately 270°. Therefore, the perimeter of drain tile 12, as shown best in FIGS. *4c–4e*, may have an upper edge 23 and a lower edge 25 which define a longitudinal opening along one side of form 10. Drain tile 12 may, therefore, be attached to form 10 at upper intersection 24 and lower intersection 26 along the upper and lower respective edges 23 and 25 of the perimeter of the longitudinal opening of drain tile 12.

As further shown in FIG. 2, drain tile form F has a female end 30 and a male end 40. Male end 40 has a male extension 42 of drain tile 12 that extends beyond end 74 of form 10.

Female end 30 has sleeve 32 formed integrally with or attached to drain tile form F. Sleeve 32, while having the same cross-sectional shape as drain tile 12, is larger than drain tile 12, so that male extension 42 of an adjacent section of the combined form and drain tile of the present invention may be slid into sleeve 32, thereby providing a means to engage adjacent sections of the combined form and drain tile. End face 28 of female sleeve 32 is coextensive with end face 76 of form 10. When male extension 42 is slidably engaged into sleeve 32, end face 76 of form 10 may butt against end 74 of form 10, providing a stop to engagement. Alternatively, there is an end surface 34, shown in FIG. 3 located at female end 30 of drain tile 12, which may butt against end face 44 of drain tile 12, thereby providing a stop to engagement.

Also shown in FIG. 2 are a plurality of drainage holes 14, a plurality of anchor holes 16 and a plurality of anchor tie holes 18. Drainage holes 14, which extend through the wall thickness of drain tile 12, provide the means by which water enters the drain tile of the perimeter drainage system. Drainage holes 14 are arranged in a plurality of circumferential rows spaced along the length of drain tile 12.

Anchor holes 16 extend through the wall thickness of drain tile 12, in both the upper and lower segments of drain tile 12 (see FIG. 3). Anchor holes 16 are provided in drain tile 12, so that anchors 56, as best shown in FIG. 1, may be passed through drain tile 12 and into the ground. Several anchor holes 16 are provided which are equally spaced along the length of drain tile 12. In this manner, drain tile form F may be secured in the desired position in the foundation trench. Wire may be wound around anchor 56, and through anchor tie holes 18 provided at each location corresponding to the location of anchor holes 16, to secure drain tile form F to anchor 56, and thereby prevent slippage of the form during construction.

Drain tile form F may be manufactured with drain tile 12 having a variety of cross-sectional shapes. FIGS. 4*a*, 4*b*, 4*c*, 4*d* and 4*e* show representative cross-sections. FIG. 4*a* illustrates a U-shaped drain tile 12. FIG. 4*b* shows a drain tile 12 having a round cross-section. In FIG. 4*c*, upper segment 82 of drain tile 12 is round, while lower segment 84 of drain tile 12 most closely resembles one-half of a U-shape. FIG. 4*d* shows drain tile 12 having curved back 80, planar upper segment 82 perpendicular to form 10, and planar lower segment 84 perpendicular to form 10. FIG. 4*e* shows a cross-section of drain tile 12 that is square.

Also shown in FIGS. 2, 3 and 4*a*–4*e* are the relative dimensions of form portion 10 and drain tile 12. Form 10 has height HF which is larger than height HT of drain tile 12. In the preferred embodiment of this invention, drain tile 12 is attached intermediate to form 10, such that form 10 extends beyond upper intersection 24 and lower intersection 26 to form respective upper and lower form extensions 20 and 22. In the preferred embodiment, upper form extension 20 is longer than lower form extension 22. In this way, when drain tile form F is put into place, form 10 acts as a wall for the footing form, and spacing is provided underneath drain tile 12, so that a portion of aggregate backfill 58 may be placed under drain tile 12.

In another embodiment of the present invention shown in FIG. 5, there is corner drain tile form CF. Corner drain tile form CF is formed in an L-shape and may have an interior angle Θ, such as 30°, 45°, 60° or 90°. Corner drain tile form CF may be made from two segments, 100 and 102, of drain tile 12 which are joined along line 62 by welding or gluing. Segment 100 includes drain tile 12, form 10, and sleeve 32 like that of drain tile form F. Segment 102 includes drain tile 12, form 10 and male extension 42 extending beyond face 74 of form 10. Segments 100 and 102 also include a plurality of drainage holes 14, anchor holes 16 and anchor tie holes 18.

Referring now to FIG. 6, there is shown slip-over connector SC. Slip-over connector SC is comprised of hollow tubular portion 112 having drainage holes 114. Tubular portion 112 has spaced upper and lower edges, 132 and 134, respectively, which define a longitudinal opening along one side of tubular portion 112. In the embodiment shown in FIG. 6, the cross-section of slip-over connector SC is U-shaped, but could be manufactured in any of the other cross-sections shown in FIGS. 4*b*–4*e*. Slip-over connector SC may be used where adjacent sections of drain tile form F, one not having male end 40 and the other not having female end 30, are to be butted together. Slip-over connector SC is slid over the two adjacent sections of drain tile form and the butt joint therebetween, and may be secured to the underlying sections of drain tile form with wire ties passed through drainage holes 114.

Shown in FIG. 7 is corner slip-over connector CS. Corner slip-over connector CS may be made from two segments 120 and 122, which are joined in an L-shape along line 162 as by welding or gluing. Segments 120 and 22 include tubular portions 112 with drainage holes 114. Segments 120 and 122 each have spaced upper and lower edges, 132 and 134, respectively, defining a longitudinal opening along one side of each segment. Corner slip-over connector CS may be used where corner drain tile form CF cannot be used. Corner slip-over connector CS is slid over the two adjacent sections of drain tile form, and may be secured to the underlying sections of drain tile form with wire ties passed through drainage holes 114.

Drain tile 12 acts as a conduit for water which may come to be near the building foundation. The backfill of soil 60 and aggregate 58 helps to channel the water away from wall 52 and footing 50 into drain tile 12 through drainage holes 14. This alleviates the problem of water pooling around the building foundation which may lead to leakage or seepage. Form 10 acts as a wall of the form constructed as a receptacle for receiving cementitious material, such as cement or concrete, and in which the cementitious material is allowed to set or harden. Form 10 may also act as a closure for drain tile 12.

In constructing a foundation having a perimeter drainage system, a trench is formed in the ground. In the trench, a form is built as a receptacle for cementitious material. The form is built using drain tile form F and corner drain tile form CF, as well as slip-over connector SC and corner slip-over connector CS, as required. The pieces of forms F and CF would be positioned in the trench, such that form 10 acts as the outside wall of the form, with drain tile 12 extending away from the interior of the building and the form, as shown in FIG. 1.

As the form is being constructed, segments of drain tile form F and corner drain tile form CF may be secured in place using anchors 56, as shown in FIG. 1. Anchors 56 may be wood or metal stakes or pieces of rebar. Anchors 56 are inserted into and through anchor holes 16 in tubular portion 12 and into the ground. To prevent slippage, drain tile form F and corner drain tile form CF may be secured to anchor 56 with wire ties wound through anchor tie holes 18 and around anchor 56. Adjacent sections of drain tile form F and corner drain tile form CF may be connected together to form a unitary system by sliding male extension 42 into female sleeve 32. Where adjacent sections of drain tile form F and/or corner drain tile form CF do not have respective male extension 42 and female sleeves 32, slip-over connector SC and/or corner slip-over connector CS may be employed to maintain continuity of the perimeter drainage system.

After the footing form is completed, cementitious material is poured into the form and allowed to set. Because the combined form and drain tile of the present invention was used as the form, the form need not be removed. Aggregate and soil backfill may now be added to the trench. Anchors 56 may or may not be removed as well.

Prior to the advent of the present invention, the form would have to be removed, after which conventional drain tile would be placed into the trench adjacent the foundation. The combined form and drain tile of the present invention allows for a novel construction process. Because the combined form and drain tile is used as a wall of the footing form, the form is not removed. This saves both time and cost in the construction of the foundation of a building requiring a perimeter drainage system.

Drain tile form F, corner drain tile form CF, slip-over connector SC and corner slip-over connector CS may be manufactured from flexible or rigid polyvinylchloride (PVC) or other suitable plastic material. Well-known extrusion methods may be employed to manufacture these elements as single integral parts. Alternatively, drain tile 12 and form 10 of drain tile form F and corner drain tile form CF may be manufactured separately and then attached to each other as by welding or gluing. By way of example and not of limitation, typical wall thicknesses (for PVC tubing) of $\frac{1}{8}$ inch to 3/16 inch may be employed. By way of example and not of limitation, typical heights HF of forms 10 include 6 inches, 8 inches and 12 inches, and would correspond to heights HT of drain tile 12 of 3 inches, 4 inches and 6 inches, respectively. Other wall thicknesses and heights, HF and HT, may be employed. Drainage holes, anchor holes and anchor tie holes may be drilled or molded.

Given the above disclosure, many other features, modifications and improvements will become apparent to those skilled in the art. Such other features, modifications and improvements are, therefore, considered to be a part of this invention, the scope of which is to be determined by the following claims.

I claim:

1. A combined form and drain tile, comprising:

a hollow tubular drain tile having first and second ends, a plurality of drainage holes, a plurality of equally spaced anchor holes, and upper and lower edges defining a longitudinal opening along one side of said drain tile and wherein said first end is oversized so as to enable slidable engagement with the second end of a like drain tile;

a form portion of shorter length than said drain tile attached to said drain tile along said upper and lower edges, and wherein said form has oppositely oriented, laterally spaced side edges, an anchor tie hole corresponding to each of said anchor holes, a first end coextensive with said first end of said drain tile, a second end which is overextended by said second end of said drain tile, an upper form extension overextending the upper intersection of said drain tile to said form, and a lower form extension overextending the lower intersection of said drain tile to said form.

2. The combined form and drain tile of claim 1, wherein said upper form extension is longer than said lower form extension.

3. The combined form and drain tile of claim 1, wherein said drain tile is one of round, U, or square shaped.

4. The combined form and drain tile of claim 1, wherein said side edges are parallel.

5. A combined form and drain tile, comprising:

a planar longitudinally extending form having oppositely oriented laterally spaced side edges;

a hollow tubular drain tile secured to said form intermediate said edges and extending substantially the length thereof;

a plurality of drainage holes in said drain tile for admitting liquid into said drain tile;

wherein said form further includes oppositely oriented, laterally spaced first and second ends; and said drain tile further includes a first end coextensive with said first end of said form and a second end extending beyond said second end of said form.

6. The combined form and drain tile of claim 5, wherein said first end of said drain tile is larger than said second end, so as to allow slidable engagement of said first end with the second end of a like drain tile.

7. The process of forming a foundation, including a perimeter drainage system, comprising the steps of:

forming a trench;

providing a combined form and drain tile assembly, the assembly including a hollow tubular drain tile having first and second ends, a plurality of drainage holes, a plurality of equally spaced anchor holes, and upper and lower edges defining a longitudinal opening along one side of said drain tile and wherein said first end is oversized so as to enable slidable engagement with the second end of a like drain tile and a form portion of shorter length than said drain tile attached to said drain tile along said upper and lower edges, and wherein said form has oppositely oriented, laterally spaced side edges, an anchor tie hole corresponding to each of said anchor holes, a first end coextensive with said first end of said drain tile, a second end which is overextended by said second end of said drain tile, an upper form extension overextending the upper intersection of said drain tile to said form, and a lower form extension overextending the lower intersection of said drain tile to said form;

positioning the assembly with the form portion vertically disposed in the trench thereby providing a receptacle;

filling the receptacle with cementitious material;

allowing the cementitious material to set; and backfilling the trench first with aggregate and then with soil.

8. The process of claim 7, including the step of providing one of cement and concrete as the cemetitious material.

* * * * *

UNITED STATES PATENT AND TRADEMARK OFFICE

CERTIFICATE OF CORRECTION

PATENT NO. : 5,406,758

DATED : April 18, 1995

INVENTOR(S) : Melvin R. Baum

It is certified that error appears in the above-identified patent and that said Letters Patent is hereby corrected as shown below:

On title page, item [54],
IN THE TITLE:

Please cancel "DRIAN TITLE" and insert --DRAIN TILE-- therefor.

Column 1, line 1, please cancel "DRIAN TITLE" and insert --DRAIN TILE-- therefor.

Signed and Sealed this

Eighteenth Day of July, 1995

Bruce Lehman

*Attest:*

BRUCE LEHMAN

*Attesting Officer*

*Commissioner of Patents and Trademarks*